United States Patent [19]

Foster, Jr. et al.

[11] Patent Number: 4,897,973

[45] Date of Patent: Feb. 6, 1990

[54] MODULAR SUN BLOCK SYSTEM

[75] Inventors: William A. Foster, Jr., Baltimore, Md.; Vincent S. Pedrick, 1637 Riverwood Rd., Baltimore, Md. 21221

[73] Assignee: Vincent S. Pedrick, Baltimore, Md.

[21] Appl. No.: 155,859

[22] Filed: Feb. 16, 1988

[51] Int. Cl.[4] ..... E02D 27/00

[52] U.S. Cl. ..... 52/102; 47/33; 404/7

[58] Field of Search ..... 52/60, 102, 169.5, 169.12, 52/169.14, DIG. 3, 58, 242, 288; 256/32; 404/7; 47/33

[56] References Cited

U.S. PATENT DOCUMENTS

| | | | |
|---|---|---|---|
| 1,349,340 | 8/1920 | Hotchkiss | 404/7 |
| 2,249,979 | 7/1941 | Reardon | 404/7 |
| 3,310,814 | 3/1967 | Lipman | 52/102 X |
| 3,477,181 | 11/1969 | Robinson | 52/103 |
| 3,619,944 | 7/1970 | Matvey | 47/33 |
| 3,694,979 | 10/1972 | Vadnie | 52/169.12 |
| 3,745,701 | 7/1973 | Marvin | 47/33 |
| 3,785,099 | 1/1974 | Greene | 52/102 |
| 3,788,001 | 1/1974 | Balfanz, Jr. | 404/7 |
| 3,803,760 | 4/1974 | Matvey | 47/33 |
| 3,827,201 | 8/1974 | Struben | 52/169.12 |
| 4,074,479 | 2/1978 | Krupka | 404/7 |
| 4,478,391 | 10/1984 | Kovach | 256/1 |
| 4,508,319 | 4/1985 | Tappen et al. | 47/33 |
| 4,549,378 | 10/1985 | Ayers et al. | 52/169.12 |
| 4,663,883 | 5/1987 | Hillard et al. | 47/33 |
| 4,690,382 | 9/1987 | Koperdak | 256/1 |
| 4,735,395 | 4/1988 | Dahowski | 249/10 |

FOREIGN PATENT DOCUMENTS

| | | | |
|---|---|---|---|
| 3127920 | 1/1983 | Fed. Rep. of Germany | 47/33 |

*Primary Examiner*—Carl D. Friedman
*Assistant Examiner*—Michele A. Van Patten
*Attorney, Agent, or Firm*—Michael W. York

[57] ABSTRACT

A system for installation around foundation portions of houses, sidewalks, wire fences and mobile homes inhibits weed growth, assembling to form a series of end-to-end abutted sheet metal shields that includes tread plates extending along the assembly as a portion of it. Connectors at intervals provide selectively a slide fit and a snap fit to the tread plate and a spaced series of angled sheet metal upright stakes that can be pushed when desired into the ground by the user's foot, either before or after assembly of the system.

6 Claims, 3 Drawing Sheets

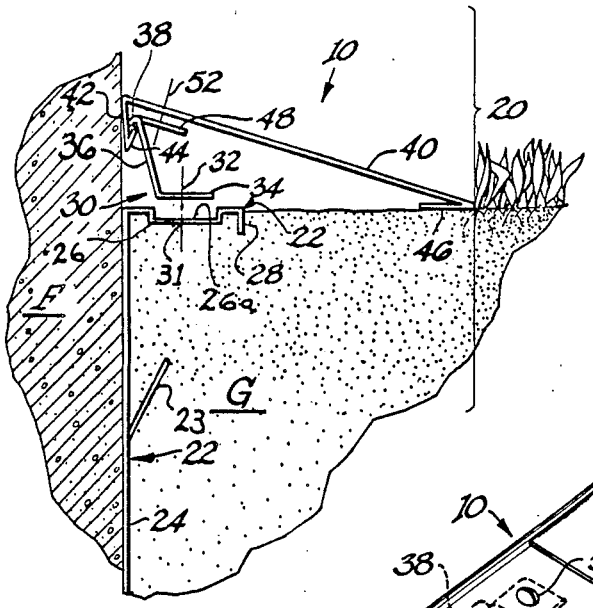
Fig. 1.
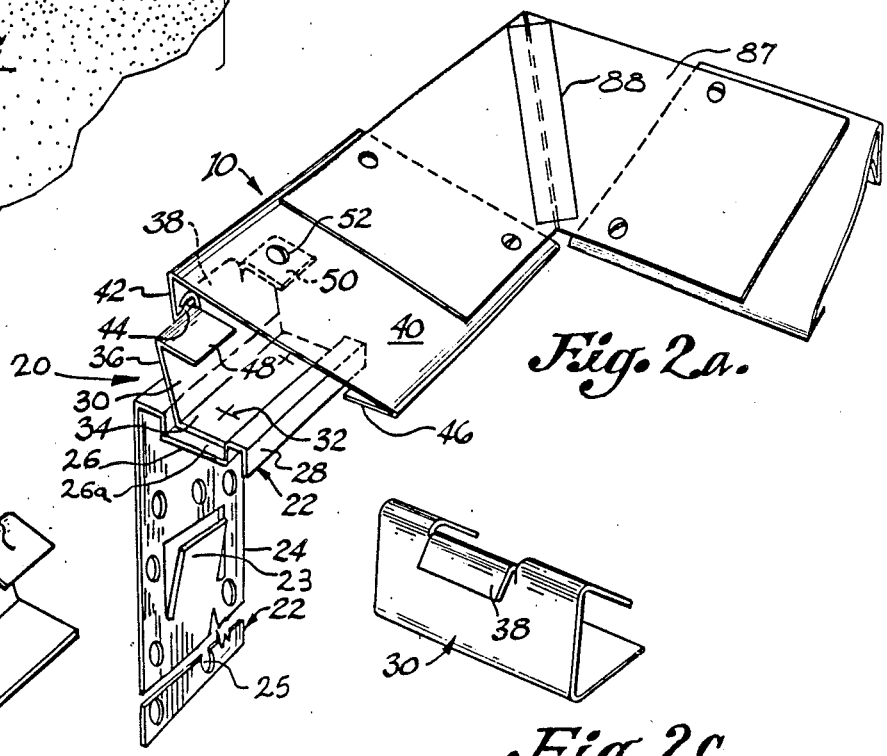
Fig. 2a.
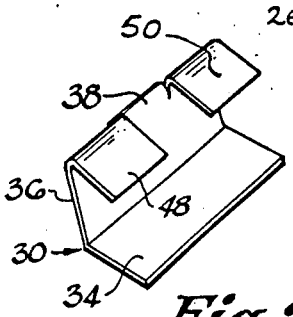
Fig. 2b.
Fig. 2c.
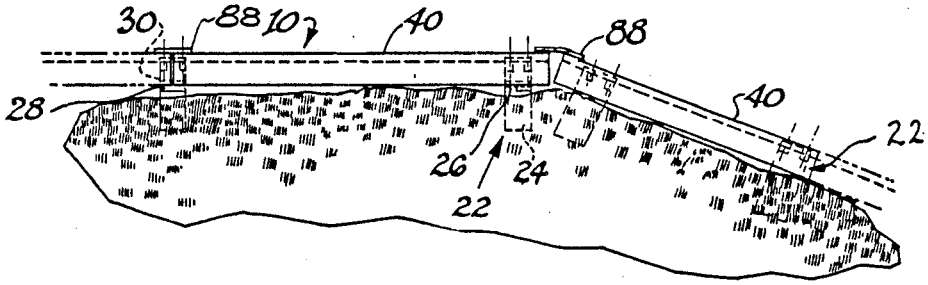
Fig. 3.

MODULAR SUN BLOCK SYSTEM

FIELD OF THE INVENTION

This invention relates generally to shields and particularly to a system for blocking growth of vegetation around the perimeters of houses, trailers, fences and walkways.

BACKGROUND OF THE INVENTION

Known anchored vegetation-blocking assemblies are often difficult to assemble and not easily applicable to a variety of foundations and the like. In addition they require relatively thick material for rigidity and numerous parts that can loosen in use. They may be metal or plastic.

SUMMARY OF THE INVENTION

This invention provides a system of sheet metal parts that can, in contrast with prior systems, easily be inserted into the ground and snapped or slid together by an elongate tread that serves also as a trim for installation around houses, trailers, fences and walkways.

Objects in addition include providing such a system that is safe, strong and quick to install, economical, durable, lightweight and attractive in appearance. Further objects are to provide a system as described that is compact and easily shipped and stored.

BRIEF DESCRIPTION OF THE DRAWINGS

The above and other objects and advantages of this invention will become more readily apparent on examination of the following description, including the drawings in which like reference numerals refer to like parts.

FIG. 1 is an end elevational diagram, partly exploded, of a preferred first embodiment of the invention installed at a foundatin;

FIG. 2*a* is a perspective view thereof, of further details of the first embodiment;

FIG. 2*b* is a perspective view of a detail shown in FIG. 2a;

FIG. 2*c* is a perspective view of a detail shown in FIG. 2*a;*

FIG. 3 is an elevational diagram, partially fragmentary, of an embodiment installed on rough ground;

DETAILED DESCRIPTION

Figure 4:
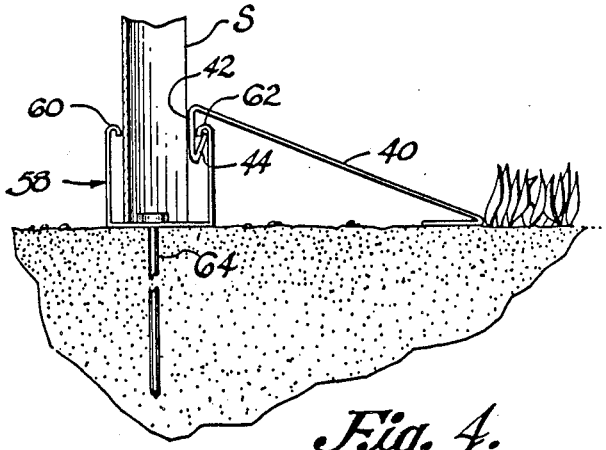
FIG. 4 is an end elevational view of a further embodiment installed at a trailer skirt.

FIGS. 1, 2*a* and 3 detail embodiment 10 of the invention blocking weed growth, sealing against excessive inflow of water at the perimeter of a building foundation F and providing for support of wheels, not shown, of a rotary mower for mowing close to the foundation, and FIGS. 2*b* and 2*c* detail components thereof.

The embodiment 10 includes as principal elements, an elongate assembly 20 with the following:

A plurality of spaced-apart sheet metal stakes 22, each in the form of an angle or angle piece having a first, vertical leg 24 extending down and anchoring into the ground G at the foundation F and a second,generally horizontal leg 26 extending generally perpendicularly therefrom in a direction away from the foundation F. The horizontal leg may have one or more, preferably two, fastener holes 31 therein, and, parallel spaced from leg 24, a second vertical leg, 28, extending downward. The vertical leg 24 has means for anchoring in the ground and to roots of grass or other vegetation, in the form of a central lanced-out rectangular door-like portion 23 in area about ⅝ the size of the vertical leg and connected to it at the bottom of the portion 23, which preferably is formed at a 30 degree angle outward under the horizontal leg. Additionally, a plurality of relatively large holes, 25, adapted to receive a hold root growth is provided, and serves to attach to a fence by fasteners, and also serves to lighten the structure as well.

The horizontal leg 26 has stiffening means and means for locking it to the ground and for holding parts attached to it more securely than if it were simply flat, in the form of a special shape. This shape is a recessed trough formed by an inner vertical sidewall and an outer vertical sidewall extending down from inner and outer upstanding edges, at right angles to a flat bottom as shown at 26*a*.

A plurality of spring clips 30 are affixed to the members 22 by the screw fasteners 32, preferably equal in spacing number and location to the sheet metal stakes. If desired, fastening holes can be drilled by the user (or corresponding holes therethrough can be supplied) by which the screw fasteners 32 hold together the sheet metal stakes 22 and spring clips 30. Each spring clip 30 has the horizontal body portion for extra strength and security fitted into a respective trough 26*a* affixed to a stake as noted. Each spring clip has at an angle thereto, an upward flange 36 with the edge in the form of an open hook 38 facing downwardly and inwardly toward the foundation F (FIG. 1) which it touches on installation. The spring clips 30 may be pre-loaded toward the foundation F for sealing out growth and water by pressure on downward flange 42 of elongate tread 40.

Last of all to be installed is the elongate tread or tread plate 40 with, at the foundation F, the downward flange 42 ending in an upward hook 44 facing outward from the foundatin in position for snapping onto and engaging the hook 38 of the spring clip 30, and sloping down from the upward hook to a turned-under or hemmed lower edge 46 resting on the ground G substantially beyond the lateral extent of the other parts of the elongate assembly 20.

Better to secure the tread plate 40 to the spring clip 30 in addition to the hooks 38, 44 on the sides of the hook 38, pads or tabs 48, 50 are provided. These incline from the upper edge of the spring clip, outwardly and downwardly under the tread plate and at the same angle as the tread plate, so that, if desired, by screws 52 the tread plate can be fastened to the pads 48, 50. The holes may be drilled by the user, as noted.

The hook 38 can help take the weight of any vertical load on the tread plate 40 so that the edges of the hooks will not flex out of engagement. The foundation F can help prevent pivotal disengagement, that otherwise might occur by lift of the free edge 46 of the tread plate. The body of the tread plate is substantially planar.

It can be seen that there are no sharp edges, the elongate assembly being abutted to another one at each end, with, if desired, the tread plate slid enough out of register to provide overlap. Disassembly is easy by removal of the screws and sliding of the tread plates, which may be cut to length on the job.

The drawings are substantially in proportion. The sheet metal used may be of 22 gauge (0.029 inch; 0.1 mm) thick electrolytic zinc-coated sheet of steel, or alternatively of 3003 aluminum 0.050 inch (0.125 mm) thick. The elongate assemblies may be: 48 to 68 inches (1.1 m to 1.4 m) long; the deeper flange 24 of the angles 22 may be: 6 to 8 inches (15 to 20 cm) deep vertically; 13/4 to 2 inches (4.5 cm to 5 cm) deep horizontally and 3 to 4 inches (7.5 to 10 cm) wide horizontally. The tread plates may be 4 to 5 inches (10.5 to 12.5 cm) wide. The ground engaging portion may be pressed into the ground by pressure on the sheet metal stakes after assembly, or better, rocked from side to side and pressed into the ground and then assembled. Rough ground (FIG. 3) can be no problem: assembly can be made at relative inclines along the length, and polypropylene connective straps can bridge the span between juxtaposed ends of the pieces, or duct tape 88 can be used for this.

At corners, mitered plastic pieces 87 may be secured by screws to the tread 40 between the ends and sealed by duct tape 88.

For commercial or industrial or institutional use heavier gauge sheet metal may be used, for example, 0.0598 inch (1.5 mm) electrolytic zinc coated or 0.1 inch (25 mm) thick 3003 aluminum may be used.

FIG. 4 shows an installation of the tread plate 40 as trim for a customary trailer base shirt or shielding S, which is conventionally in the form of a sheet of corrugated metal (or plastic).

A "U"-shaped trough 58 with returned upper edges 60, 62 and secured into the earth by nails 64, clips to the tread plate 40 described in reference to FIGS. 1–3 and hooks to it at the hook structure 42, 44 by means of the edge return shown at 62.

Figure 6:
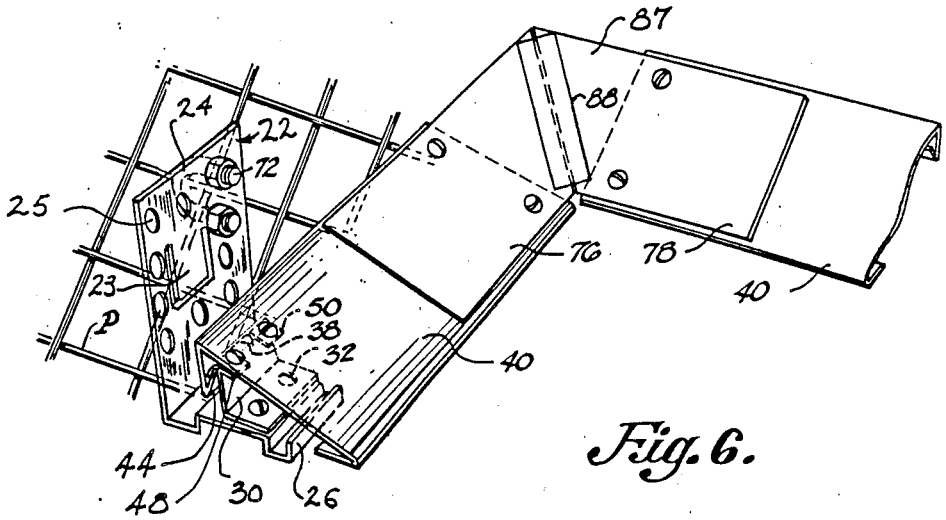
FIG. 6 is a perspective view of the FIG. 5 showing.
Figure 5:
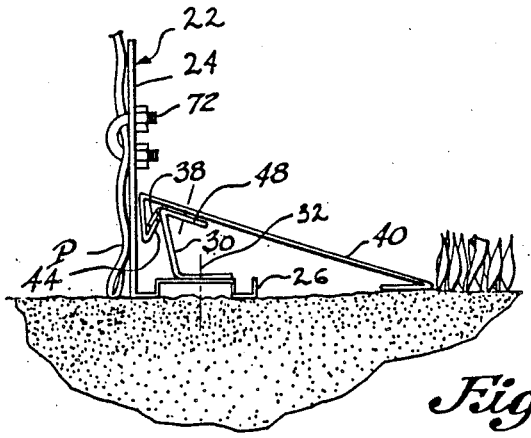
FIG. 5 is an end elevational view of a further embodiment installed at a fence.

FIGS. 5 and 6 show a spring clip 30 and tread plate 40 hooked to a woven wire privacy fence P bottom edge by means of an angle 22 with vertical leg 24 secured to the fence by a "U"-bolt 72 and horizontal leg 26 below turned outward and having secured to it, by screw fasteners 32, the spring clip 30. The spring clip 30 has a hook 38 engaging hook flange 44 of tread plate 40 and on either side a fastening pad or tab 48, 50 as described in reference to FIGS. 1–3. Adjustment by holes 25 is provided to raise or lower the "U"-bolt point of connection. A mirror-image arrangement of the FIG. 5 elements could be added on the left side of the fence and the angles (see 22) could be held by the same "U"-bolt. If a picket fence is used instead of a wire fence, holes 25 may be used as screw holes for securing to it, and the "U"-bolt need not be used. Lanced-out portion 23 may be engaged with the wire fence in this arrangement and, if not, if in-plane with the vertical leg 24.

Shown also is a typical provision for closure at mitered plastic corners 87,a length of pressure sensitive or bonded duct tape 88.

Figure 7:
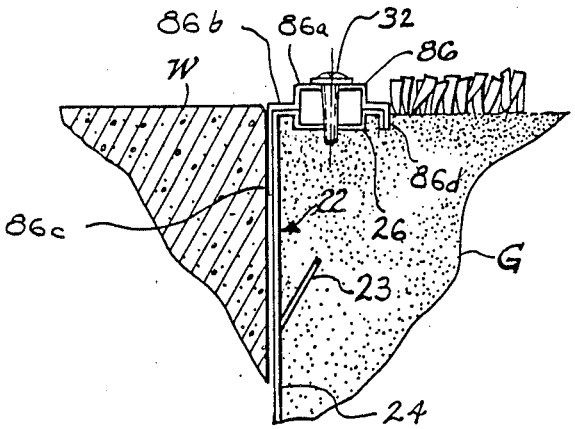
FIG. 7 is an end-elevational view of a subcombination of an embodiment installed at a walkway.

It will be evident that the structures shown in FIG. 2*a* and in FIG. 7 can be used to form,with additional such structures, a rectangular frame for placement around shrubs, trees, flower beds and the like, as trim.

Figure 8:
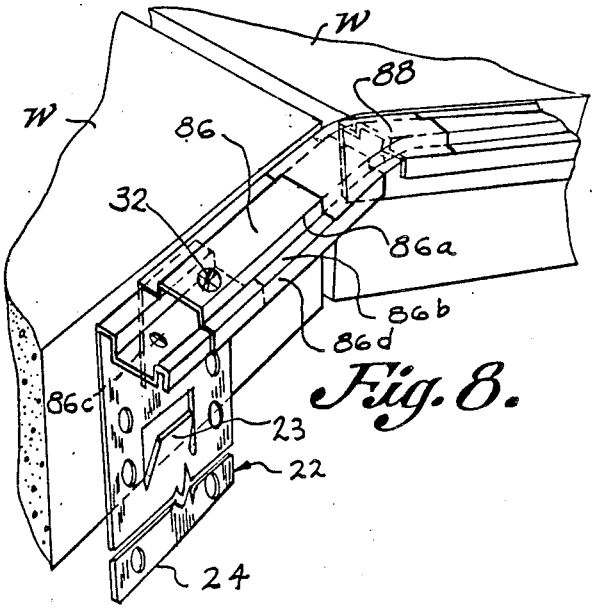
FIG. 8 is a perspective view showing further details thereof.

FIGS. 7 and 8 show use of a subcombination of the invention to trim along a masonry walkway W.

For this a sheet metal stake or angle 22 as shown before may be used. Covering this stake and screwed to it as at 32 is a relatively long channel 86. Bridging over the gap between lengths of this channel can be a flat polypropylene strip or duct tape 88.

The channel 86 comprises an inverted rectangular trough 86*a* with on each side a horizontal flange 86*b* extending outward from each arm. From the outer edge of each flange extends a downward arm 86*c*, 86*d* the arm 86*c* being substantially longer than the other arm. Size of channel 86 between the downward arms is such as to receive and cover the horizontal portion 26 of angle 22 in nested fashion. A screw fastener 32 draws together the horizontal portions of channel 86 and angle 22; it is evident that any resilience will act as a lock washer, and that arm 86c will tightly close the space between a walk W and ground G.

Figure 9:
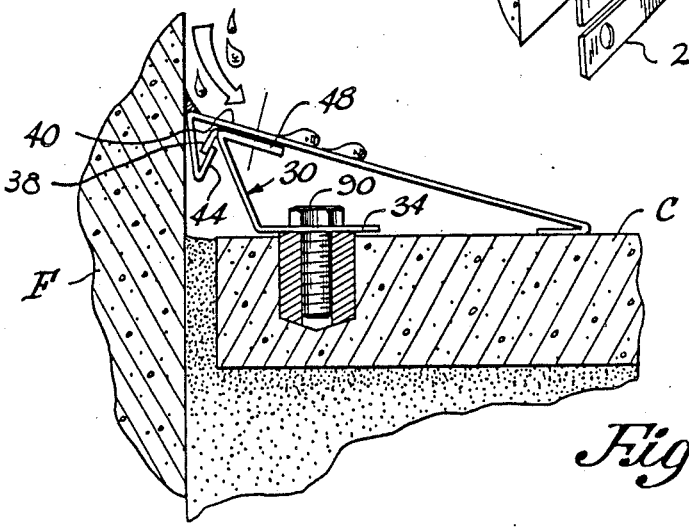
FIG. 9 is an end view partly in section showing the invention installed at the juncture of a sidewalk and a foundation.

FIG. 9 shows generally the same spring clip 30 and tread 40 element indicated in FIGS. 1–3 and elsewhere, here sealing between an edge of a foundation F and of a cement walkway C. A common expansion bolt 90 secured into the walkway C holds the horizontal body portion 34 of the spring member 30 in position to force the hook 38 of member 30 against hook 44 and the foundation F. The tab structure, 48 shown, maintains strength and rigidity as before.

Broadly, as used in this disclosure, the word "foundation" may include any trailer skirt, house foundation, lower edge of fence, or walkway, to which the invention is juxtaposed. posed.

A source of commercially obtainable sheet aluminum angles and channels is: Earle M. Jorgensen Co., 10700 Alameda Street, Lynwood, Calif. 90262 and of sheet steel rust resistant angles and channels is: Inryco, 4601 North Point Blvd., Baltimore, Md. 21219. A preferred color for the elements disclosed herein would be lawn green.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. Structure for inhibiting vegetative growth on the ground adjacent a foundation comprising the combination of a plurality of angle pieces for anchoring the structure to the ground adjacent the foundation, each of said angle pieces having a short angle arm and a long angle arm with the short angle arm extending generally perpendicular to said long angle arm and having stiffening means located thereon, an elongated tread having a flange with a hook portion located thereon and means for detachably affixing the plurality of angle pieces to the elongated tread in spaced relation to each other on assembly, said means for detachably affixing the plurality of angle pieces to the elongated tread including a plurality of spring clips each having a portion thereof shaped to be located on one of said angle pieces and means for securing each spring clip to one of said angle pieces, each said spring clip having at least one hook thereon oriented and located for springing into engagement in assembly with an adjacently located hook portion located on the flange of said elongated tread.

2. The structure of claim 1 wherein the stiffening means of the short angle arm of said angle pieces comprises an open trough shaped portion.

3. The structure of claim 2 wherein the long angle arm of said angle pieces has a bent out portion projecting at an angle outward from said long angle arm and toward the short angle arm.

4. The structure of claim 3 wherein each said spring clip has at least one tab portion located adjacent the hook of said spring clip.

5. The structure of claim 4 wherein the long arm of each of said angle pieces has a plurality of holes for receiving and holding root growth.

6. The structure of claim 1 further comprising at least one additional elongated tread and associated angle pieces and spring clips and wherein each tread has end portions and further comprising flexible means for connecting an end portion of one elongated tread with the end portion of an adjacently located elongated tread.

* * * * *